United States Patent [19]

Stumpf et al.

[11] Patent Number: 4,529,247

[45] Date of Patent: Jul. 16, 1985

[54] ONE-PIECE SHELL CHAIR

[75] Inventors: William E. Stumpf, Winona, Minn.; Donald T. Chadwick, Los Angeles, Calif.

[73] Assignee: Herman Miller, Inc., Zeeland, Mich.

[21] Appl. No.: 368,578

[22] Filed: Apr. 15, 1982

[51] Int. Cl.[3] ..... A47C 1/02; A47C 5/12

[52] U.S. Cl. ..... 297/301; 297/457; 297/DIG. 2

[58] Field of Search ..... 297/457, 285, 299, 300, 297/306, DIG. 2, 301

[56] References Cited

U.S. PATENT DOCUMENTS

| | | | |
|---|---|---|---|
| D. 197,644 | 3/1964 | Sundberg et al. . | |
| D. 217,450 | 5/1970 | Craddock . | |
| D. 240,375 | 7/1976 | Buhk . | |
| D. 259,688 | 6/1981 | Ambasz . | |
| 2,395,468 | 2/1946 | Eames | 5/DIG. 1 |
| 3,111,344 | 11/1963 | Hoven et al. | 297/DIG. 2 |
| 3,337,265 | 8/1967 | Benzing . | |
| 3,669,496 | 6/1972 | Chisholm . | |
| 3,966,252 | 6/1976 | Albinson . | |
| 4,084,850 | 4/1978 | Ambasz | 297/300 |
| 4,200,332 | 4/1980 | Brauning . | |
| 4,235,408 | 11/1980 | Sapper | 297/302 X |

FOREIGN PATENT DOCUMENTS

| | | | |
|---|---|---|---|
| 154346 | 11/1953 | Australia | 297/457 |
| 32839 | 7/1981 | European Pat. Off. . | |
| 1080256 | 12/1954 | France | 297/457 |

*Primary Examiner*—Victor N. Sakran
*Assistant Examiner*—Peter R. Brown
*Attorney, Agent, or Firm*—Varnum, Riddering, Schmidt & Howlett

[57] ABSTRACT

A one-piece shell chair (10) includes an unitary integrally formed shell body (12) having a flexurally supported seat pan (14) and a flexurally supported backrest (16) defined in part by an H-shaped opening (20) in the shell body. The backrest (16) and the seat pan (14) resiliently flex as independent units in response to an occupant's body shape, size, posture and positioning. Integral, flexible straps join the backrest (16) to the seat pan (14) to permit resilient flexing of the backrest (16) with respect to the seat pan (14) about an axis through the occupant's hip joint to minimize shear between the backrest and the occupant's back during flexing movement of the backrest 16 with respect to the seat pan 14. The seat (12) is mounted to a tilt mechanism (28) which pivots the seat (12) about an axis forward and below the front edge (14*a*) of the seat pan (14) enabling the user's feet to remain stationary on the floor. Accordingly the seat (12) and tilt mechanism (28) provide a comfortable, convenient and accommodating chair (10).

17 Claims, 8 Drawing Figures

ONE-PIECE SHELL CHAIR

DESCRIPTION

1. Technical Field

The invention relates to chair constructions and, in particular, to a posture chair having an one-piece shell structure. In another of its aspects, the invention relates to a posture chair having a tilt mechanism which cooperates with an independent seat and backrest of a one-piece shell chair.

2. Background Art

Recent research has suggested that seating comfort can affect productivity of workers who must work in a sedentary position. Comfort requires that support be provided to the user at certain critical points to relieve strain on the principal support areas of the body and to relieve circulation impairment. Strain can lead to posterial disorders and spinal complaints. Pressure on the peripheral nerve endings underneath the thighs, for example can lead to the feeling that one's legs are "falling asleep."

Thus, comfort for purposes of productivity requires that the chair be closely tailored to a person's size and shape. To this end, height adjustments have long been provided on chair spindles. However, height adjustments do not take into consideration other differences between sizes and shapes of people. Recently, rather sophisticated mechanisms have been developed to change relationships between seat and backrest to accommodate different size and shape persons. These mechanisms rely on buttons and levers of mechanical or electromechanical nature for adjustment. In addition to being complicated and expensive to manufacture, these types of chairs require a learning process to operate and need constant or repetitive attention to the controls. The use of these chairs to achieve their desired ends of necessity becomes a self-conscious process which militates against the effectiveness of the chairs.

Research has also demonstrated that the same user, when occupying a chair, may assume a variety of different positions. One position may be assumed when working at a work surface, a second position may be assumed when the user is engaging in conversation, and a third position may be assumed when the user is relaxing. In between these three broad categories, there may be a whole host of slightly different positions as a result of micromovements of the user. Thus, the chair must accommodate not only different sizes and shapes of people but also accommodate a host of different positions. User-operated mechanical gadgetry is simply inappropriate to accomplish the myriad of different positions because the user will not continually make adjustments to accommodate the micromovements and probably not even accommodate the major movements. The chairs must be an analog of the shape and movements of the user to accomplish the tactile response necessary to maintain muscle and mind stimulation for long-term productive activity.

Watkin in European patent application No. 0,032,839, published July 29, 1981, discloses a shell chair which is made from a relatively pliable plastic material which, in combination with appropriately placed holes and slits, is locally deformable to conform to the occupant's size and shape. The chair is formed with an extensive lip along the sides and upper back and is provided with a frame so that the backrest as a whole remains relatively fixed with respect to the seat. The localized deformation apparently is intended to function somewhat like padding and will accommodate poor postural positions of the occupant. An H-shaped opening is provided by slits between the backrest and the seat to aid in the local deformative function. The Watkin chair does not maintain appropriate postural relationship of the occupant and will not accommodate all different modes of use such as work surface, conversation and relaxing.

It has also been recognized that a vertical cushioning is important to reduce vertical loading of weight on the skeletal frame structure of the human body. To this end, more expensive chairs have been provided with pneumatic cylinders and mechanical springs in the spindle to cushion the loading process which occurs when one sits. Again, these devices are effective but relatively expensive, they sometimes wear out and are not practical to include in side chairs and stacking chairs.

Tilt mechanisms are well recognized in the chair art. Most of these mechanisms tilt about an axis to the center of the chair. When the user tilts in these chairs, it can result in the tilting off the center of gravity which results in an unnatural reaction by the user. Further, the front edge of the seat is lifted away from the floor which raises the user's legs vertically and frequently moves the feet off the floor. This action has a tendency to impair circulation in the legs of the user. The reaction of the user to this tilting applies stress and compression to portions of the body, resulting in fatigue.

Some mechanisms are designed to tilt about an axis at the front of the seat. The reaction to the user is still believed to be somewhat unnatural with such a tilt mechanism.

Representative of the art to accommodate movements of users are U.S. Pat. No. 3,982,785, issued Sept. 28, 1976, and U.S. Pat. No. 4,084,850 issued Apr. 18, 1978. Both of these patents disclose chairs with seats which automatically slide backward and forward while the backs tilt backwardly independent of the movements of the seat.

DISCLOSURE OF THE INVENTION

According to the invention, there is provided a chair adapted to provide postural support to a wide variety of people of different shapes of sizes through a variety of seated positions. The chair comprises a shell with a backrest and a seat pan integrally formed of a structurally resilient material. A U-shaped slot is formed in the seat pan, the slot extending from back portions of the seat pan along side portions thereof to define a cantilevered seat support extending rearwardly from a forward portion of the seat pan and leaving seat webs extending rearwardly from the forward portion of the seat pan. A base is mounted to the shell at the seat webs and the seat webs are of a cross-sectional configuration, the shell material is of a composition with sufficient rigidity and flexural strength and the seat pan is shaped so as to allow resilient flexing of the seat pan and forward portion of the seat pan substantially as a unit with respect to the web about a flexure axis transverse to the seat webs. The base is shaped and mounted to the seat pan in such a way as to avoid interference with the flexing of the cantilevered seat support and seat pan forward portion as a unit with respect to the seat webs. The flexure of the seat pan about the flexure axis reduces the shock of seating, accommodates different shape users and accommodates movements of the user in various postural relationships within the chair.

A U-shaped slot is also formed in the backrest near the side and lower portions thereof to form a cantilevered back support extending downwardly from an upper portion of the backrest and leaving back webs adjacent the back support, the back webs being of a cross-sectional configuration, the backrest being of a shape and the shell material having sufficient rigidity and flexural strength so that the cantilevered back support and upper backrest support resiliently flex as a unit with respect to the back webs about a flexure axis transverse to the back webs. Thus, the backrest support automatically adjusts to different size and shape persons and automatically accommodates different postural positions of the user in the chair.

Desirably, the U-shaped slots are joined at bight portions thereof to form a continuous opening between the cantilevered seat support and the cantilevered back support. In a preferred embodiment of the invention, the U-shaped slots join at bight portions thereof to form an H-shaped slot leaving a flexure web on each side of the shell between the seat support and the backrest support. The flexure web, being joined to the seat web and the back web, is so shaped that the backrest resiliently flexes with respect to the seat pan independent of any flexing of the cantilevered seat support and seat pan front portion with respect to the seat web and independent of any flexing of the cantilevered back support and upper backrest portion with respect to the backrest web. The flexure web may be reinforced with fibrous materials such as fiberglass or carbon fibers. The flexure web has a curvature and flexibility such that the flexure web deflects over a continuum of points to provide an apparent pivot point displaced radially inwardly of the flexure web whereby shear forces on the back of an occupant during tilting of the backrest with respect to the seat pan are reduced or minimized.

The legs of the U-shaped slot in the seat pan extend forwardly a distance sufficient to enable flexing of the cantilevered seat support and the front portion of the seat pan as a unit. To this end, the legs of the U-shaped slot in the seat pan will extend forward at least one-half and preferably two-thirds of the back-to-front length of the seat pan. The back portion of the cantilevered seat support is further provided with means for rigidifying the cantilevered seat support and a positioning means to locate the occupant's seat for proper postural relationship with respect to the backrest. In a preferred embodiment of the invention, these two functions are served by an upwardly-extending lip at the back portion of the cantilevered seat support.

In one embodiment, the base comprises a means for pivoting the shell about an axis formed forward of the user's center of gravity. Preferably, in this embodiment, the base comprises means for pivoting the shell about an axis below the knee of the user, specifically near the ankle of the user. In this manner, a natural tilting of the user can take place without any unnatural reactions induced by the tilting from an off center position. Further, with this mechanism, undue pressure at the underside of the thighs is minimized so as to minimize restriction of circulation during the tilting action.

Further, according to the invention, there is provided a chair including a seat and backrest adapted to provide postural support to a wide variety of people of different shapes and sizes through a variety of different seat positions. Means in the seat and backrest react to the shape and movements of the user to maintain appropriate support in the back and seat. A base is mounted to the seat and backrest and comprises a tilt mechanism adapted to permit rotation of the seat and backrest about an axis beneath the knee and forward of the center of gravity of a user.

The unitary shell of the invention is molded from a high strength resilient plastic material, for example, fiberglass reinforced polyester resin. The molded shell may be covered with foam and/or fabric or used simply in shell form, thus easily accommodating a variety of different design forms. The basic structure achieves a very basic and simple design, is easy to manufacture with mass production techniques, and thus is adaptable for a wide variety of low priced or high priced applications. The shell accomplishes a variety of different shape and size people through the flexually suspended seat pan and backrest, and further accommodates micromovements of all types of people through the cantilevered supports. Further, the webs between the seat and backrest provide a flexing of the backrest with respect to the seat pan in a manner to accommodate shifts in user positions from, for example, a work surface position to a relaxing position.

BRIEF DESCRIPTION OF THE DRAWINGS

The invention will be described with reference to the accompanying drawings in which.

BEST MODE FOR CARRYING OUT THE INVENTION

Figure 1:
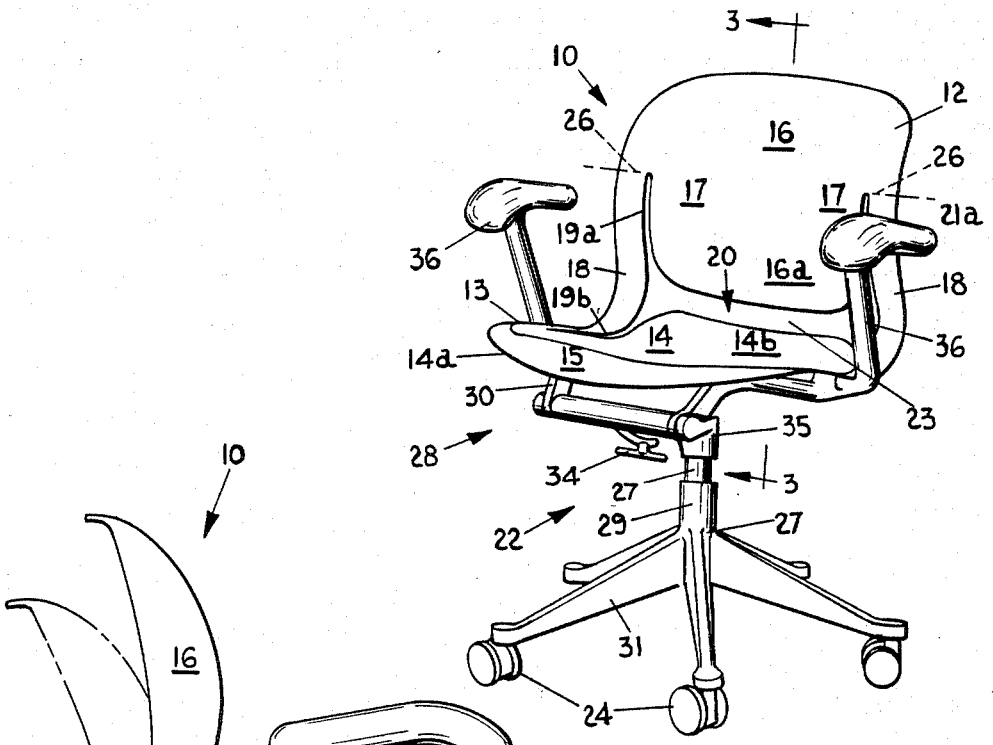
FIG. 1 is a perspective view of the preferred embodiment of the invention.

Referring to the drawings where like numerals have been used to describe like parts and to FIGS. 1–5 in particular, a chair 10 has a unitary shell body 12 supported on a tilt mechanism 28 which in turn is supported on a five-star roller base 22. The shell body 12 is generally configured to the correct postural shape of a human torso in an ordinary seated position and is adapted to accommodate different body shapes and sizes while maintaining correct postural support. The shell body 12 reacts to the user's macro and micro-movements without the necessity of any adjustments to the chair 10. Accordingly, the chair 10 is both convenient and comfortable.

The unitary shell 12 is formed by a seat pan 14 and a backrest 16 with a generally H-shaped opening 20 therebetween and joined by resilient webs 18. The H-shaped opening 20 has two leg slots **19*a*, 19*b* and 21*a*, 21*b* which extend from a mid-back portion 17 of the backrest 16 to a mid-thigh portion 15 of the seat pan 14 near side edges of the seat pan 14 and backrest 16. The leg slots 19*a*, 19*b* and 21*a*, 21*b* are coextensive with each other and are joined by a horizontal cross-slot 23. The slots 19*b*, 23 and 21*b*** define a cantilevered seat support 14*b* and the slots 21*a*, 23 and 19*a* define a cantilevered back support 16*a*. As used herein, the portions of the straps 18 adjacent the slots 19*b* and 21*b* are called "seat web" and the portions of the straps 18 adjacent the slots 19*a* and 21*a* are called "back web." The seat straps and the back straps are joined by a "flexure web." The slots 19*b* and 21*b* extend forwardly in the seat at least one-half of the back-to-front seat length thereof and preferably about two-thirds of the back-to-front length. The length of the slots 19*b*, 21*b* is selected to provide a convenient flexure axis of the seat as a unit with respect to the straps 18 adjacent the slots 19*b*, 21*b*. Typically the length of the slots will be in the range of 11 to 15 inches measured from the end of lip 14*c* along the centerline of the seat support 14*b*.

The flexure axis for the seat with respect to the straps 18 will generally be at the forwardmost point of slots 19*b*, 21*b*. Thus, in the embodiment shown in the drawings, the flexure axis for the seat is indicated by the phantom line 25 in FIG. 3. Thus, the entire seat pan 14, except for straps 18, including the seat support 14*b* and the front edge 14*a*, moves as a rigid unit about flexure axis 25 when the seat is occupied and shifts in weight distribution on various portions of the chair occur. The flexure movement of the chair seat 14 about the flexure axis 25 is illustrated in phantom lines in FIG. 4.

An upturned lip 14*c* is formed on the back portion of the cantilevered seat support 14*b* to rigidify the seat support 14*b* and to form a positioning means for correct placement of the occupant in the seat. The cantilevered seat support 14*b* is generally concave in shape and defines a surface which is closely contoured to the human ischial tuberosities.

In like manner, a flexure axis 26 results at the upper portion of the straps 18 adjacent the end of the slots 19*a*, 21*a*. The backrest 16, except for the back webs, moves as a unit, flexing about flexure axis 26. The slots 19*a*, 21*a*, which control the location of the flexure axis 26, extend up along the sides of the backrest to a point generally between a midpoint on an occupant's spine at the intersection of the thorascic curve and the lumbar curve. In terms of the backrest structure, the slots 19*a*, 21*a* extend up the backrest about half way between the seat and top of the backrest for a normal size backrest. The relative length would be different for a low-back chair or a high-back chair but the absolute length of the slots 19*a*, 21*a* from the bottom of the back support 16*a* would be about the same, e.g. in the range of 6 to 8 inches.

Figure 4:
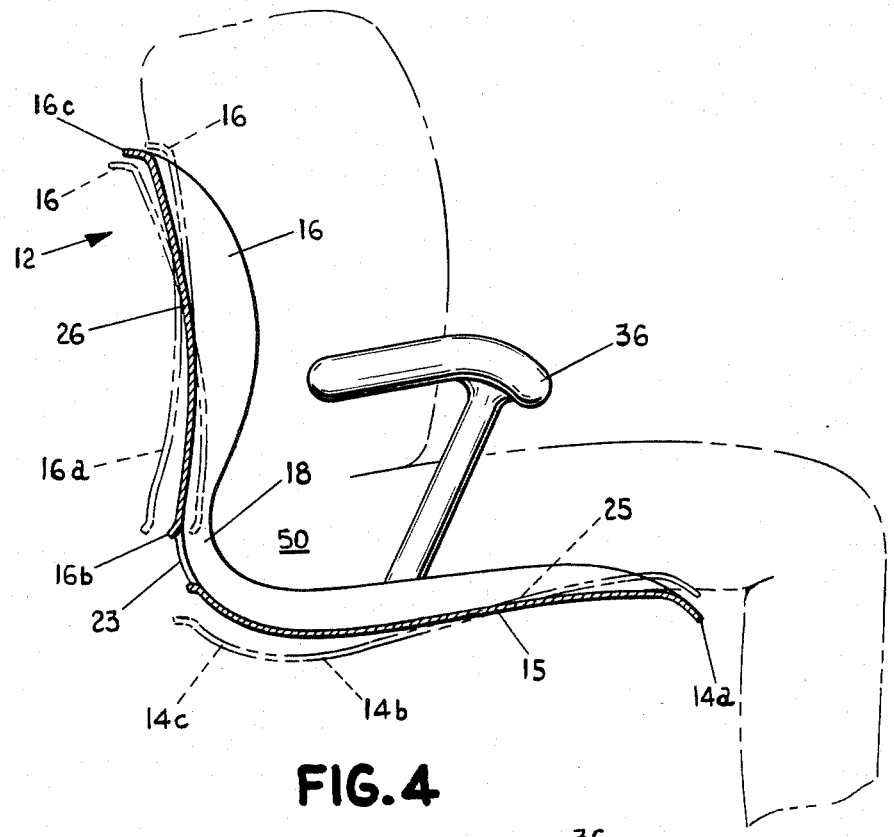
FIG. 4 is an enlarged cross-sectional view of the chair taken along lines 4—4 of FIG. 3.
Figure 3:
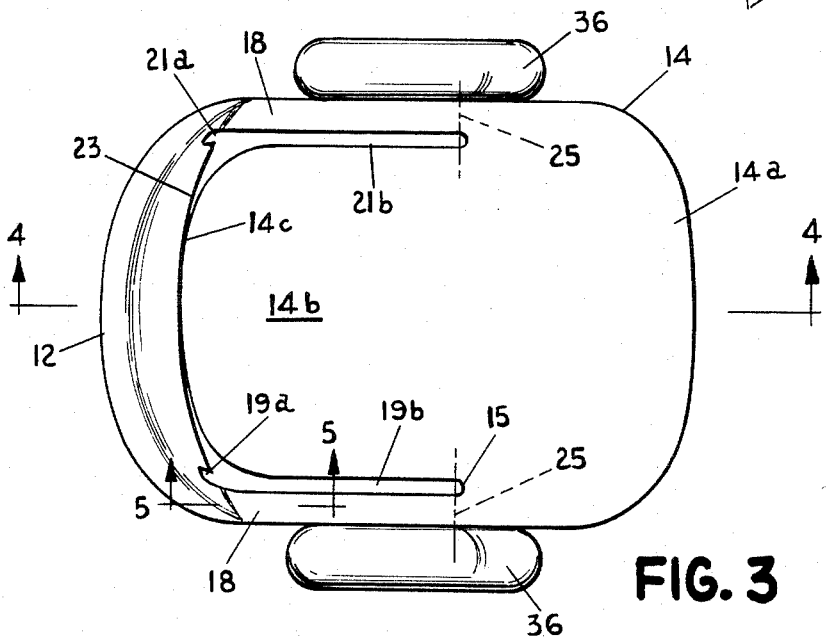
FIG. 3 is a plan view of the chair shown in FIGS. 1 and 2.
Figure 5:
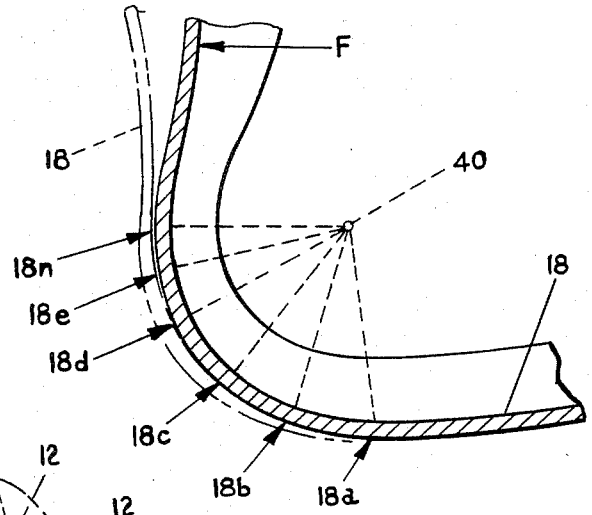
FIG. 5 is an enlarged sectional view taken along lines 5—5 of FIG. 3.

As illustrated in FIG. 4, the backrest has a convex shape in vertical cross-section to conform with the shape of the spine of a human torso seated in the chair. The bottom portion of the back support 16*a* is turned outwardly at 16*b* to avoid pinching between the edges of the seat support 14*b* and back support 16*a*. In addition, the top portion of the backrest 16 has an outwardly turned rim 16*c*. Both the outwardly turned rim 16*c* and the outwardly turned bottom edge 16*b* provide rigidity to the backrest so that the backrest moves as a whole about the flexure axis 26. The movement of the backrest as a unit about flexure axis 26 is illustrated by phantom lines in FIG. 4.

The shell seat 12, including the seat pan 14 and backrest 16, may be covered with padding and/or a fabric material for the further comfort of the occupant or aesthetic reasons or may be used simply in the shell form. The padding can be formed in an in-situ molding process with the padding being molded to the chair through a well-known foam molding process. One or both sides of the shell can be covered so long as there is little or no restriction of the cantilevered supports 16*a* and 14*b* with respect to the straps 18. Conventional upholstery can also be used. The H-shaped opening 20 may also be viewed as two U-shaped slots joined at the bight portions thereof. It is conceivable that the bight portions of the U-shaped slot need not join and a portion of the shell could divide the two U-shaped slots.

The unitary shell 12 is preferably integrally formed in one piece from a strong, resilient structural material, for example, molded plastics with high flexural modules and flexural strength. A suitable material is fiberglass-reinforced polyester formed by an elastic molding process described in U.S. Pat. Nos. 3,193,437 issued July 6, 1968; 3,193,441 issued July 6, 1975; 4,239,571 issued Dec. 16, 1980; and 4,034,139 issued July 5, 1977. Steel or other structural reinforcements such as glass or carbon fiber may be incorporated into the resilient webs 18 for strength, especially at the curved portion between the seat and backrest, at which location maximum stress occurs during backward pressure and tilting. An example of a suitable material which can be used for molding the chair is a low-cost general-purpose resin sold by Composite Technology Corporation under the designation ERM Composite. This composition, when molded has properties as follows:

| Property | Value | Test Method |
|---|---|---|
| Thickness | 3 mm | — |
| Weight | 1.1 lbs/ft$^2$ | — |
| Reinforcement: | | |
| Glass | .4.0 oz/ft$^2$ | — |
| 10-mil Surface Veil | .1 oz/ft$^2$ | — |
| Specific Gravity | 1.76 | ASTM D792 |
| Flexural Strength | 24.7 × 10$^3$ psi | ASTM D790 |
| Flexural Modulus | 1.57 × 10$^6$ psi | ASTM D790 |
| Tensile Strength | 11.2 × 10$^3$ psi | ASTM D638 |
| Tensile Modulus | .81 × 10$^6$ psi | ASTM D638 |

The load-deflection characteristics of the material can vary depending on the desired rigidity of the shell. As an example of suitable characteristics for a fiberglass reinforced polyester material, the deflection of the backrest with respect to the seat can increase relatively linearly from zero to four inches at the midpoint thereof when a load of 110–120 lbs. is applied. With this same material, the deflection of the seat at about 13.75 inches from the front thereof will increase linearly to 2.5 inches with a force of 180 to 200 lbs. applied at the centerline of the seat at the bottom of the concave seat support 14*b*. Also, the backrest will deflect linearly about the flexure axis a distance of about 3 inches at a point 2 inches from the top of a chair as a result of a force of about 27 to 37 lbs. applied at the centerline of the backrest at that point.

Other materials such as molded plywood, sheet metal, e.g. steel, aluminum and metal-reinforced plastics can also be used so long as the materials have a relatively high flexural modulus.

The shell seat 12 is supported at the sides 13 of the seat pan 14 by the tilt mechanism 28 which allows the seat 12 to pivot with respect to the base 22. The tilt mechanism 28 has two frame members 30 forming lever arms which are connected at one end thereof to the straps 18 adjacent the slots 19*b* and 21*b* with conventional fasteners (not shown). Between the other ends of the frame members 30 is a torsion bar 32 which restrains the tilting of the chair 10 when occupied. The torque or resistance which is provided by the torsion bar 32 is adjusted by an adjusting handle 34 which tightens or loosens the stiffness of the torsion bar 32, affecting the resistance of the tilt mechanism 28 to pivot. The tilt mechanism 28 is preferably made of cast aluminum. Torsion-bar tilt mechanisms are well known in the chair iron art and for that reason will not be further described herein. Alternatively, a bushed rubber spring can be used in lieu of the torsion bar 32. Preferably, the axis of the tilt mechanism is so positioned that the axis of rotation of the chair user will be forward of the user's center of gravity, preferably forwardly of the front of the chair and below knee level, preferably at ankle level. By this mechanism, the user can tilt back in the chair without increased pressure beneath the thighs and without a loss of a sense of balance. In this connection, it is seen in FIG. 4 that the front edge 14*a* of the seat pan 14 rises slightly as the seat pan flexes about the flexure axis 25. This rise is compensated for by the pivoting of the chair about axis of rotation of the tilt mechanism. Thus on tilting of the chair and flexing of the seat pan 14, the front edge 14*a* will not rise with respect to the floor.

The tilt mechanism 28 is supported by the pedestal base 22 which includes an adjustable height mechanism 27, a five-pronged frame 27 and five rollers 24. The adjustable height mechanism can be any conventional height mechanism which allow height adjustment by rotation of the shell 12 about the base 22, thereby enabling one to select the vertical height at which the seat pan 14 is positioned. Mechanical height adjustment mechanisms are also well known in the chair base art and, for this reason, will not be further described herein. Each of the five rollers 24 is connected to a prong 31 of the frame 27 in conventional fashion. Although the base 22 is depicted as having wheels, a fixed wheelless base can alternatively be used.

The chair 10 may come equipped with a variety of other features. For instance, a pair of chair arms 36 can be connected to the frame members 30 through the support base 38. The arms 36 can be flexible and deflect downwardly with pressure from the user. Alternatively, a tablet arm (not shown) may be supported by the frame members 30. The backrest 16 can be lower or extend higher than shown for different applications. Additionally, the pedestal base 22 can be accommodated with a tubular, circular foot ring (not shown). Still further, the shell body 12 can be mounted on a variety of other types of support bases such as a horizontal tubular support, a four leg stacker base, or a sled base as will be described hereinafter. In all cases, the base can be mounted to the straps 18 of the seat pan 14 through flexible urethane or rubber shock mounts in the manner shown in U.S. Pat. Nos. 2,969,831 issued Jan. 31, 1961 and 2,893,469, issued July 7, 1954.

When a user or occupant sits in the chair 10, the seat pan 14 and backrest 16 react simultaneously to the body, size, shape and movement of the occupant, comfortably and resiliently yielding to the occupant's body. In particular, when the occupant places his/her posterior 50 in the seat pan 18, as illustrated in FIG. 4, the seat and backrest independently flex rearwardly and downwardly, respectively, about flexure axes 26 and 25, respectively, to accommodate the size and shape of the occupant. However, a correct postural relationship between the occupant's seat and back is maintained due to the rigidity of the material. The resistance of flexing of the seat and backrest is determined by the strength of the material in the shell 12. The flexing of the seat provides a shock absorption for the occupant during sitting in addition to a tactile response to the user's shape and micromovements. Accordingly, since the occupant's body, shape, size, movement and positioning will determine, in part, the extent of the flexing of the seat and backrest, the seat pocket 18 can accommodate a short, rotund occupant as well as a tall, lean occupant, and all those who fall inbetween.

The straps 18 between the seat pan 14 and the backrest 16 provide a flexing of the backrest 16 with respect to the seat pan 14 when the occupant tilts backwardly, for example, or when the occupant simply leans backwardly. The flexing of the backrest 16 with respect to the seat pan 14 will be described with reference to FIG. 5 which is an enlarged cross-sectional view of the flexure web of strap 18. When a force F is applied to the backrest 16, that force is transmitted through the straps 18 to the base which is held rigid. The straps will flex about a continuum of points 18*a* to 18*n* between the fixed portion of the seat webs of straps 18 to the flexure axis 25 with most deflection occurring at the flexure web. The flexing of the flexure web along a continuum of points about the curved portion thereof has the effect of providing a pivot axis of the backrest with respect to the seat pan 14 radially inwardly of the flexure web, i.e., upwardly of the seat and forwardly of the backrest. Ideally, the convergence of projected individual pivot axes for each segment of the flexure web will be at or about the occupant's hip joint so that shear forces between the occupant's back and the chair backrest 16 are minimized.

The flexing between the seat pan 14 and backrest 16 in combination with the cantilevered supports 14*b* and 16*a* provides a simple, yet effective mechanism through which the user's body is properly supported in a number of complex movements to follow the body movements throughout a whole host of micro- and macro-movements. This tactile support maintains muscle stimulation automatically and thus, unselfconsciously.

From the foregoing, it is apparent that the basic shell body is simple in construction and achieves a clean, simple design which, despite the complex responses achieved, lends itself to economic mass production techniques. The basic shell body further lends itself to a wide variety of design styles so that chairs which incorporate this shell body can be used in low- or high-cost home, office or factory environments. Thus, chairs with this construction can be used for executive and factory worker applications on an economical basis.

Figure 2:
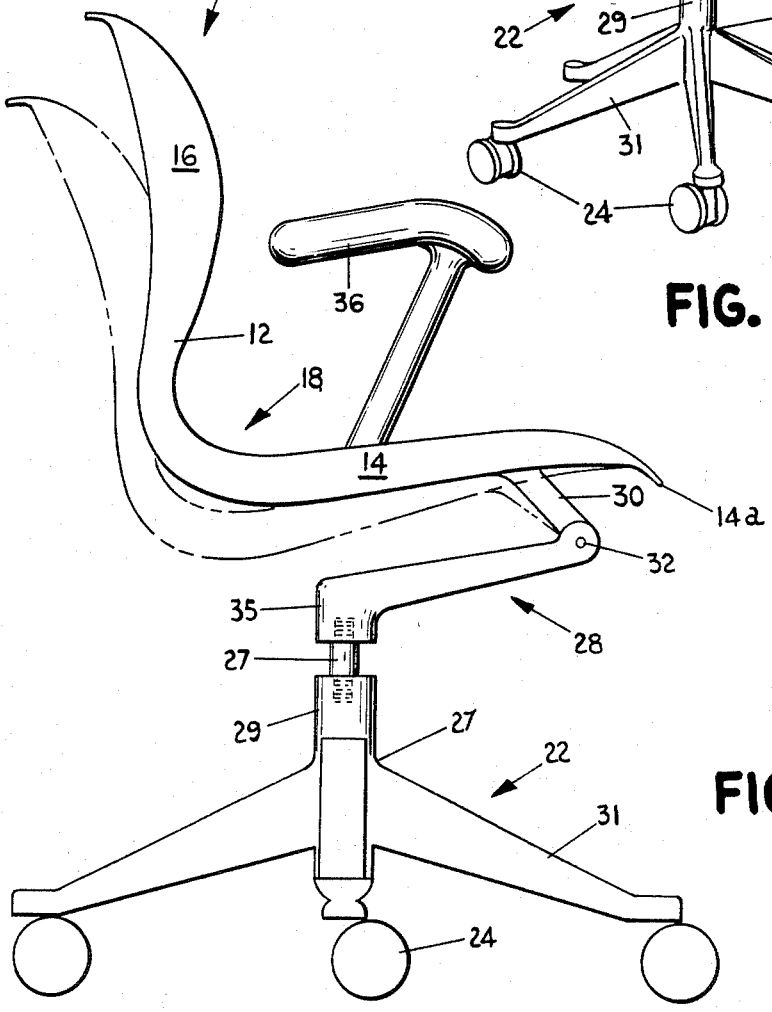
FIG. 2 is a side sectional view of the invention taken along lines 2—2 of FIG. 1.

The tilt mechanism 28 enables the seat pan 14 and backrest 16 to pivot downwardly at an angle relative to the front edge 14*a* of the seat pan 14, as best seen in FIG. 2. When an occupant sits back and reclines in the seat pocket 18, the seat pan 14 and backrest 16 will pivot below the knee or calf location of the user, thereby enabling the occupant's feet and ankles to remain stationary on the floor. Further, as the occupant leans back and moves about the seat pocket 18, the seat and backrest will flex as independent units to accommodate the occupant's body movements. Although it is preferable to have the shell 12 connected to a tilt mechanism that tilts the shell seat 12 about an axis at the front edge 14*a* of the seat pan 14 or around the occupant's knee or calf location, other types of conventional tilt mechanisms may be used such as that shown in U.S. Pat. No. 3,480,249, issued Nov. 25, 1969. In addition, the tilt mechanism can incorporate a rachet arrangement to permit forward tilting of the shell to enhance work postures in a work-surface chair embodiment.

Figure 6:
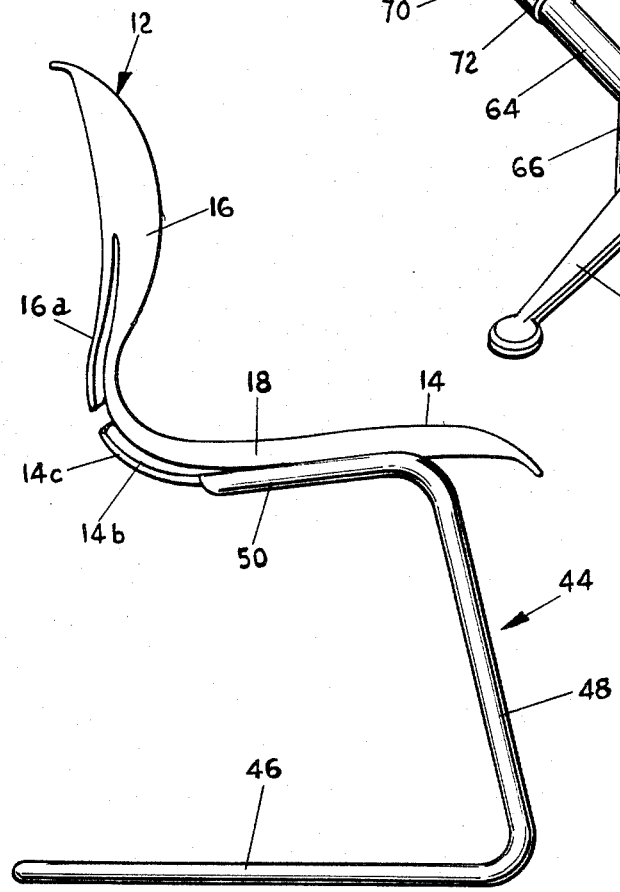
FIG. 6 is a side elevational view of a second embodiment of a chair according to the invention.

Referring now to FIG. 6, there is shown a shell body 12 constructed identically as the shell body illustrated in FIGS. 1–5 but mounted on a sled base 44. The sled base is formed in conventional fashion from a U-shaped, horizontal floor tubing 46, integrally joined to a vertical tubing 48 and horizontally-extending connector 50. The sled base 44 is secured to the chair 12 through shock mounts (not shown) which are attached to the connectors 50 and the webs 18.

Figure 7:
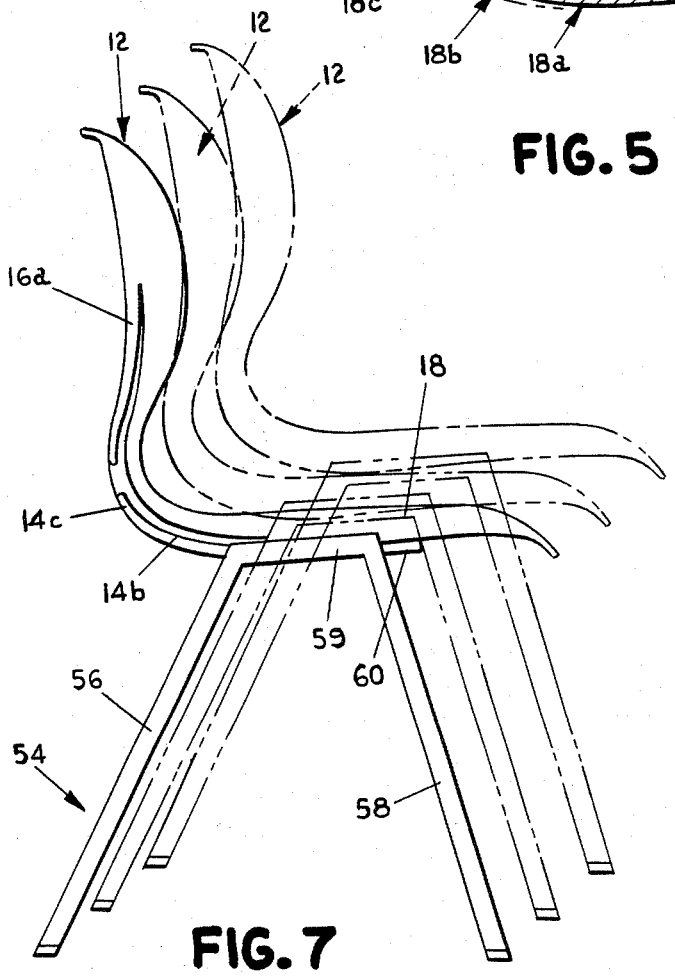
FIG. 7 is a side elevational view of a third embodiment of a chair according to the invention.

Referring now to FIG. 7, there is shown a shell body 12 of identical construction as heretofore described mounted on a stacking base 54. Legs 56 and 58 are connected at the upper portions to a horizontal connecting portion 59 to form one side of the base. An identical pair of legs (not shown) on the other side of the chair are joined to the legs 54 and 58 through a rigid connector bar 60. The base 54 is connected to the chair 12 through the straps 18 adjacent to the cantilevered seat support **14*b*. The stacking nature of the chair is illustrated by additional chairs shown in phantom lines in FIG. 7**.

Figure 8:
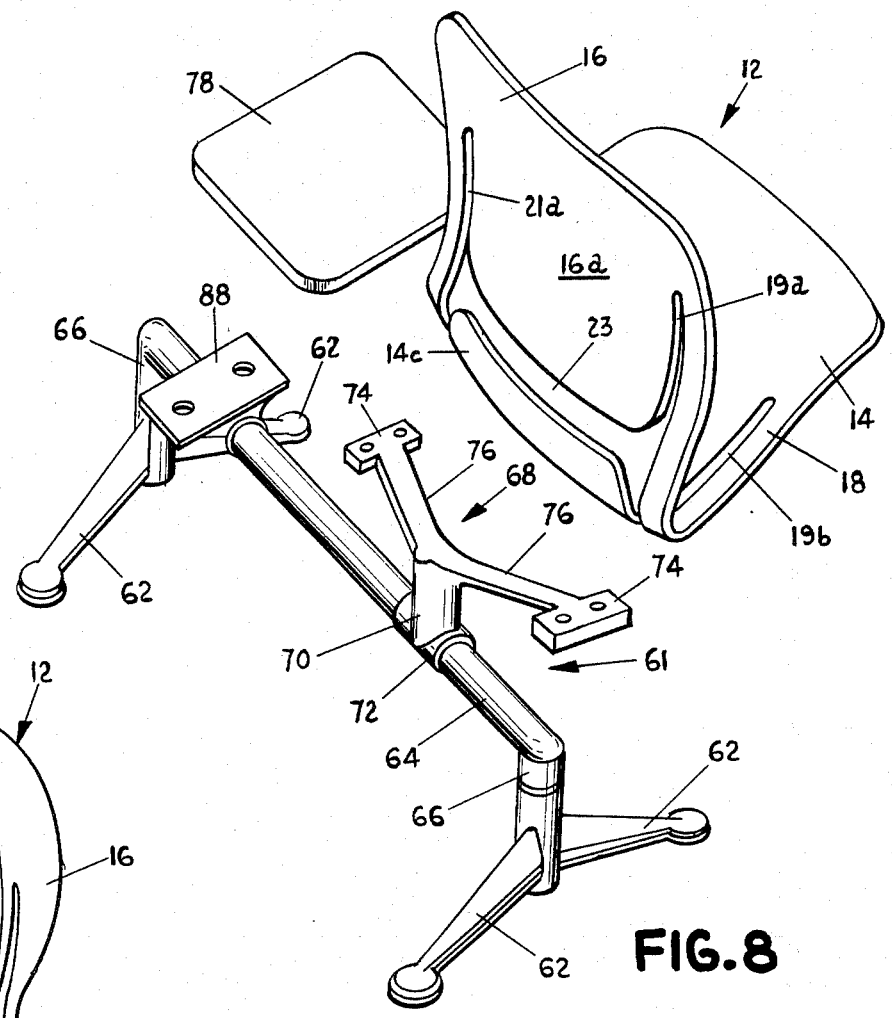
FIG. 8 is an exploded perspective view of a fourth embodiment of the invention.

Referring now to FIG. 8, a shell body 12 of a construction as described above with respect to FIGS. 1–5 is mounted on a tandem support base 61. Although only one chair is shown mounted on this base, the base can be significantly longer than illustrated and support a number of such chairs as is common, for example, in airport seating arrangements.

The tandem support base 61 comprises stabilizing feet 62 which are connected to a horizontal bar 64 through vertical posts 66. A connector 68 has a vertical frame bar 70 which is secured to the horizontal bar 64 through a collar 72. Ears 74 are connected to the vertical frame 70 through horizontally-extending arms 76. The chair 16 is connected to the base 61 through the ears 74 with conventional shock mounts as described above. Again, the ears are secured to the straps adjacent to the slots **19*b***.

The foregoing specification and drawings are merely illustrative of the invention and are not intended to limit the invention to the disclosed embodiment. Reasonable variations and changes are possible within the scope and nature of the invention which is defined in the appended claims.

The embodiments of the invention in which an exclusive property or privilege is claimed are defined as follows:

1. A chair adapted to provide postural support to a wide variety of people of different shapes and sizes through a variety of different seated positions, said chair comprising:

a shell having a backrest and a seat pan integrally formed of a structural resilient material;

a U-shaped slot formed in said seat pan, said slot extending from back portions of the seat pan along side portions thereof to define a cantilivered seat support extending rearwardly from a forward portion of said seat pan, and leaving seat webs extending rearwardly from said forward portion of said seat pan;

a base for supporting said shell;

means for mounting said base to said seat webs;

flexural axis means, including a cross-sectional configuration of said seat webs, the rigidity and flexural modulus of the composition of said shell material and the shape of said seat pan forming a flexure axis transverse to said seat webs at a forward portion of said seat webs so as to provide resilient flexing of said forward portion of said seat pan and said cantilevered seat support substantially as a unit with respect to said seat webs about said flexure axis;

whereby said forward portion of said seat pan and said cantilevered seat support resiliently flex as a unit about said flexure axis to reduce the shock of seating, to accommodate different shape users, and to accommodate movements of the user in various postural relationships within the chair.

2. A chair according to claim 1 and further comprising a U-shaped slot formed in said backrest near the side and lower portions thereof to form a cantilevered back support extending downwardly from an upper portion of said backrest and leaving back webs adjacent said back support, said backrest being of a shape and said shell material having sufficient rigidity and flexural modulus so that said cantilevered back support and upper backrest support resiliently flex as a unit with respect to said back webs about a flexure axis transverse to said back webs, whereby said backrest support automatically adjusts to different size and shape persons and automatically accommodates different postural positions of the user in the chair.

3. A chair according to claim 2 wherein the U-shaped slots are joined at the bight portions thereof to form a continuous opening between the cantilevered seat support and the cantilevered back support.

4. A chair according to claim 3 wherein said U-shaped slots join to form an H-shaped slot, leaving a flexure web at each side of said shell between said seat support and back support, said flexure web being so shaped so that said backrest resiliently flexes with respect to said seat pan independently of any flexing of said cantilevered seat support with respect to said seat webs and independently of any flexing of said cantilevered back support with respect to said backrest webs.

5. A chair according to claim 4 and further comprising means for reinforcing said flexure webs.

6. A chair according to claim 4 wherein the flexure web has a curvature and flexibility such that the flexure web deflects over a continuum of points to provide an apparent pivot point displaced radially inwardly of the flexure web, whereby shear forces on the back of an occupant during tilting of the backrest with respect to the seat pan are reduced.

7. A chair according to claim 1 wherein legs of said U-shaped slot in said seat pan extend forwardly at least one-half the back-to-front length of said seat pan.

8. A chair according to claim 7 wherein said legs of said U-shaped slot extend forward about two-thirds the back-to-front length of said seat pan.

9. A chair according to claim 1 and further comprising means at the back portion of said cantilevered seat support for rigidifying said cantilevered seat support.

10. A chair according to claim 1 or 9 and further comprising positioning means to locate the occupant's seat for proper postural relationship with respect to the backrest.

11. A chair according to claim 1 and further comprising an upwardly-extending lip at the back portion of said cantilevered seat support to add rigidity thereto and provide a positioning means for the occupant of the seat.

12. A chair according to claim 1 wherein said base comprises means for pivoting said shell about an axis forward of the user's center of gravity.

13. A chair according to claim 12 wherein said base comprises means for pivoting said shell about an axis below the knee of the user.

14. A chair according to claim 12 wherein said base comprises means for pivoting said shell about an axis near the ankle of the user.

15. A chair according to claims 1, 2, 3 or 4 wherein said shell is made from a fiberglass reinforced polyester resin.

16. A chair adapted to provide postural support to a wide variety of people of different shapes and sizes through a variety of different seated positions, said chair comprising:

a relatively rigid seat and a backrest joined together to support a user;

means in said seat and backrest for reacting to the shape and movement of users to maintain appropriate support to the back and seat of users through a variety of different postural positions within the chair;

flexural support means for supporting said rigid seat in a cantilevered fashion for flexural pivoting of said seat as a unit about a flexural axis passing transversely through a central portion of said seat;.

support means for said chair comprising a tilt mechanism and lever means extending downwardly from said seat to said tilt mechansism adapted to permit resilient rotation of said seat and backrest with respect to said support about a tilt axis beneath the knee and forwardly of the center of gravity of the user such that said seat pivots rearwardly and downwardly upon tilting; and said tilt mechanism and said flexural axis being so positioned with respect to each other such that any rise in the front portion of the seat due to pivoting of the seat as a unit rearwardly about said flexural axis is negated at least in part by relative downward movement of said front portion of said seat due to rotation of said seat as a unit backwardly about said tilt axis so that upward movement of said seat front portion is minimized during backward tilting of said seat about said tilt axis.

17. A chair according to claim 16 wherein said axis is near the ankle of a user.

* * * * *